US012351964B2

(12) United States Patent
Hackney

(10) Patent No.: US 12,351,964 B2
(45) Date of Patent: Jul. 8, 2025

(54) BATTING PIECES FOR PAPER PIECING PROJECTS AND RELATED METHODS

(71) Applicant: Stephanie Hackney, Waco, TX (US)

(72) Inventor: Stephanie Hackney, Waco, TX (US)

(73) Assignee: Hobbs Bonded Fibers NA, LLC, Waco, TX (US)

( * ) Notice: Subject to any disclaimer, the term of this patent is extended or adjusted under 35 U.S.C. 154(b) by 0 days.

(21) Appl. No.: 18/645,342

(22) Filed: Apr. 24, 2024

(65) Prior Publication Data

US 2025/0084572 A1 Mar. 13, 2025

Related U.S. Application Data

(62) Division of application No. 17/067,663, filed on Oct. 10, 2020, now abandoned.

(51) Int. Cl.

| | |
|---|---|
| ***D05B 97/12*** | (2006.01) |
| ***D05B 35/06*** | (2006.01) |
| ***D05B 91/00*** | (2006.01) |
| ***D05B 97/00*** | (2006.01) |

(52) U.S. Cl.

CPC ..... *D05B 97/12* (2013.01); *D05B 35/066* (2013.01); *D05B 91/00* (2013.01); *D05B 97/00* (2013.01)

(58) Field of Classification Search

CPC ..... D05B 35/06; D05B 97/12; D05B 97/10; D05B 91/00; D05B 35/066

See application file for complete search history.

(56) References Cited

U.S. PATENT DOCUMENTS

| | | | | |
|---|---|---|---|---|
| 4,514,175 | A * | 4/1985 | Zaruba | B44C 3/10 434/84 |
| 4,631,765 | A * | 12/1986 | Casey | A47G 9/0207 428/33 |
| 4,814,218 | A * | 3/1989 | Shane | B44C 3/12 112/475.08 |
| 5,226,468 | A * | 7/1993 | Lord | A47H 23/01 160/404 |
| 5,899,160 | A * | 5/1999 | Hoag | D05B 35/12 112/439 |
| 6,261,397 | B1 * | 7/2001 | Repp | B68G 7/08 112/117 |
| 6,722,300 | B2 * | 4/2004 | Trobaugh, III | D05B 11/005 112/470.12 |
| 7,926,433 | B2 * | 4/2011 | Preston | D05B 97/12 112/475.08 |
| 8,689,711 | B1 * | 4/2014 | Grover | D05B 11/00 112/475.08 |
| 10,368,663 | B2 * | 8/2019 | Pinoli | A47G 9/0207 |
| 2003/0106152 | A1 * | 6/2003 | Hart | A47G 9/0284 5/502 |
| 2006/0201407 | A1 * | 9/2006 | Geier | D05B 91/06 112/475.08 |

(Continued)

*Primary Examiner* — Danny Worrell

(74) *Attorney, Agent, or Firm* — Naman, Howell, Smith & Lee, PLLC; John A. Powell

(57) ABSTRACT

Methods for English Paper Piecing and paper piecing quilting projects comprised of using pre-cut individual pieces of nonwoven batting having uniform or non-uniform selected shapes and sizes as foundation pieces for creation of the patches used in the paper piecing projects and quilts and leaving those pre-cut pieces of batting that are the foundation pieces in-place in the sewn patches through completion of the paper piecing project or completion of a quilt.

18 Claims, 3 Drawing Sheets

(56) References Cited

U.S. PATENT DOCUMENTS

| | | | | |
|---|---|---|---|---|
| 2008/0289550 | A1* | 11/2008 | Preston | D05B 97/12 112/475.08 |
| 2011/0005441 | A1* | 1/2011 | Roche | D05B 19/12 112/117 |
| 2012/0231209 | A1* | 9/2012 | Grihalva | D05B 97/12 112/117 |
| 2013/0014681 | A1* | 1/2013 | Kennedy | D05B 11/00 112/475.08 |
| 2014/0283722 | A1* | 9/2014 | Pinoli | D05B 97/12 112/117 |
| 2016/0045043 | A1* | 2/2016 | Tisius | A47G 9/0284 112/118 |
| 2016/0279819 | A1* | 9/2016 | McCormick | B26B 29/06 |
| 2018/0177256 | A1* | 6/2018 | Feliu De La Pena Calvo | D03D 3/00 |
| 2018/0216267 | A1* | 8/2018 | Mason | B32B 5/028 |
| 2019/0090666 | A1* | 3/2019 | Bishop | A47G 9/0261 |
| 2019/0127898 | A1* | 5/2019 | Ritter | D05B 97/12 |
| 2019/0368095 | A1* | 12/2019 | Jackson | D05B 91/06 |
| 2020/0039103 | A1* | 2/2020 | Nabity | B26F 1/44 |
| 2020/0131680 | A1* | 4/2020 | Massey | B25H 7/02 |
| 2020/0216992 | A1* | 7/2020 | Rosenbach | D05B 97/02 |
| 2021/0108345 | A1* | 4/2021 | Hackney | D05B 35/066 |
| 2021/0115608 | A1* | 4/2021 | Miksch | D05B 69/10 |

* cited by examiner

BATTING PIECES FOR PAPER PIECING PROJECTS AND RELATED METHODS

CONTINUATION AND PRIORITY CLAIM

This application is a division of U.S. application Ser. No. 17/067,663 and also claims priority to U.S. Provisional Application No. 62/914,872 filed on Oct. 14, 2019, both of which are hereby incorporated by reference.

TECHNICAL FIELD OF THE INVENTION

The present invention is generally directed to a method of hand piecing used by some quilters known as English Paper Piecing, and sometimes simply referred to as "Paper Piecing," which is a detailed method of hand sewing and stitching that is frequently used by quilters to create decorative designs for the tops of quilts.

BACKGROUND OF THE INVENTION

With regard to quilting projects, pieces of fabric with certain shapes are sometimes called "patches," and they can be joined side by side with seams that are sewn by hand, or with the aid of a sewing machine, in a process called "piecing" or "sewing a seam." The patches may be all the same shape and size, or they may be different shapes and different sizes, but they generally will be fitted together during the piecing process to form "blocks" that are more elaborate combinations of multiple patches that have been pieced together, normally by seams sewn along their abutting edges.

In quilting, fabric is described as having both a "right" side and a "wrong" side. The "right side" of the fabric is the decorative or patterned side that the quilter intends to be visible at the front of the finished item, while the "wrong side" is the back of the fabric that will not be seen by observers viewing the finished quilt or quilted item. Fabric patches are typically layered "right sides together" to sew a seam along their abutting edges, but the finished item will have all of the right sides facing up on the front of the finished item when the quilt or quilted item is complete.

English Paper Piecing ("EPP") uses patterns or templates known as "foundation pieces," and involves stitches being made through an overlying fabric piece and directly through an underlying foundation piece. In traditional paper piecing, the quilter cuts foundation pieces in a desired size and shape to serve as both a pattern and as a base/foundation for a patch that will be constructed from fabric for a specific quilting project. A foundation piece is typically made of paper, freezer paper, specialty paper, cardstock, cardboard, or even, in some cases, plastic. The foundation piece is cut by the quilter into a specific shape having a specific size, both of which are determined by the shape and size of the fabric patch that will be made by the quilter for inclusion in a block that will be made later during the piecing process for a specific overall project. Normally in EPP projects, before sewing begins, the foundation pieces are cut by the quilter into various desired geometric shapes with straight edges such that the fabric patches that will be made can later be matched together at their points and their straight edges can be sewn together to form a block during the piecing process that is intended for a specific project.

After the foundation pieces have been cut, the quilter then cuts a piece of fabric (the "fabric piece") in roughly the same shape as the pre-cut foundation piece, but with an extra seam allowance at all of its edges (the seam allowance is usually about 3/16 to 1/4" inch) such that the fabric piece will have the same shape but will be slightly larger in size than the foundation piece. In order to create a fabric patch, the wrong side of the fabric piece is placed on the surface of the foundation piece, the seam allowance of the fabric piece is folded over the edges of the foundation piece, and the seam allowance is sewn or basted directly to the foundation piece so that the foundation piece is sewn together with and encased within the fabric piece on all sides and the fabric piece is held to the foundation piece by the thread stitches to form the fabric patch (the "EPP patch"). Once multiple EPP patches are made by the quilter, they can be sewn together into a block. Eventually when multiple blocks are completed, they can be joined together to form a whole quilt top or they can otherwise be joined to a separate quilt top, but in either case the blocks provide the decorative images of the quilt top.

During the EPP process, the foundation pieces are removed from the EPP patches prior to final completion of the quilt. Foundation pieces made out of paper, plastic, or other similar materials cannot be left within the EPP patches that become part of the final quilt top because doing so would result in a quilt that is too stiff, makes undesirable crinkling noise when manipulated, and does not have a pleasing appearance or softness. Some quilters may choose to remove the foundation pieces after a whole block is made, while others may remove each foundation piece immediately after each EPP patch is sewn. In either case, detaching and removing the foundation pieces from the EPP patches is very time-consuming and frustrating, and it often involves the use of tweezers to tear the foundation pieces out of each EPP patch. Removal of the foundation pieces also frequently weakens the seams holding the EPP patch together. Removal of the foundation pieces from the EPP patches is one of the most aggravating and difficult aspects of the EPP method.

It should also be appreciated that the traditional EPP method is entirely geared toward the specific project that the quilter is working on at the time they are performing the EPP method, such that each foundation piece and each of the EPP patches are cut by the quilter into sizes and shapes that are controlled by, and dependent upon, the overall quilt or quilted item that is being created by the quilter at that time, and therefore the traditional EPP method is inefficient.

SUMMARY OF THE INVENTION

It is an object of the present invention to provide pre-cut foundation pieces that can be used in EPP that do not have to be removed from the EPP patches prior to final completion of quilts or other quilted items. By allowing the foundation pieces to remain as part of the EPP patches, the difficulty of removing the foundation pieces is avoided and the overall integrity of each patch is maintained.

It is also an object of this invention to make the EPP method more efficient by providing multiple pre-cut foundation pieces with various shapes and geometric designs that can be used in a variety of different EPP projects by the quilter, avoiding the need for re-creation or new creation of specific foundation pieces for each specific EPP quilting project. It is a further object of this invention to allow for creation of EPP quilts that have superior appearance and superior insulating properties.

The invention hereby disclosed is best understood as providing multiple pre-cut foundation pieces with a specified shape and size that have been die cut from nonwoven batting material. While batting material is frequently placed between whole quilt tops and quilt bottoms during final quilt assembly that occurs after the quilt tops are completed, the present invention involves use of batting material that has been pre-cut into a variety of geometric shapes, such as hexagons, octagons, diamonds, squares, triangles, and other such polygonal shapes, or even circles, for use as foundation pieces for EPP projects. Because most quilts will eventually incorporate batting anyway, the use of batting material that is pre-cut into various geometric shapes and sizes for use as foundation pieces in EPP projects will not interfere with the eventual appearance or softness of the completed quilt or quilted item, and, if anything, will simply enhance the appearance and the thermal insulating properties of the completed quilts or quilted items.

In a preferred embodiment of the invention, the nonwoven batting used for the pre-cut foundation pieces is a 100% polyester batting. However, a nonwoven batting material made out of cotton or a polyester-cotton blend may also be used for pre-cutting a variety of nonwoven batting foundation pieces having predetermined sizes and shapes. In a further embodiment, such polyester, cotton, or polyester-cotton blended nonwoven battings may be coated or impregnated with a stiffening resin.

In an additional embodiment, the pre-cut foundation pieces having various geometric patterns and sizes may also be coated with an adhesive on at least one side such that they will have at least one "tacky" side and the wrong side of a fabric piece can be temporarily adhered to that side of the pre-cut nonwoven batting foundation piece using the adhesive prior to the interconnecting seams being placed through the fabric piece and the foundation piece during sewing to create the EPP patches.

DETAILED DESCRIPTION OF THE PREFERRED EMBODIMENTS

Figure 1:
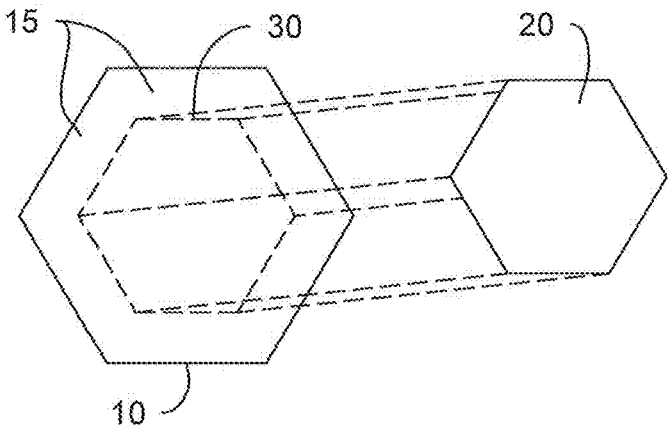
FIG. 1 is a back perspective view of an embodiment of the invention during use.
Figure 2:
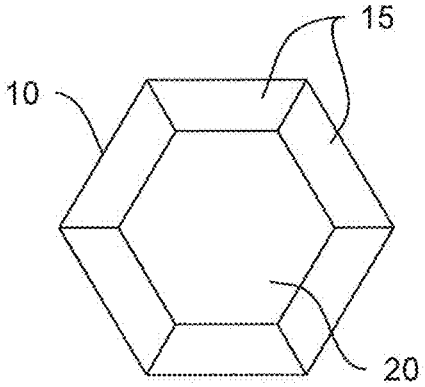
FIG. 2 is a back view of an embodiment of the invention during use.

FIG. 1 illustrates a pre-cut, hexagonal-shaped foundation piece 20 made of nonwoven batting material being applied to the wrong side of a somewhat larger hexagonal-shaped fabric piece 10. The hexagonal dotted lines 30 on the fabric piece 10 are intended to illustrate the fact that the foundation piece 20 is smaller than the fabric piece 10. Once the foundation piece 20 is centered and placed against the wrong side of the fabric piece 10, the areas between the six edges of the foundation piece 20 and the six outer edges of the fabric piece 10 will define six areas of seam allowance 15. As shown in FIG. 2, the seam allowance 15 for each of the six edges of the fabric piece 10 is folded over the corresponding six edges of the foundation piece 20 such that the foundation piece 20 will be partially encased or enveloped within the fabric piece 10.

Figure 5:
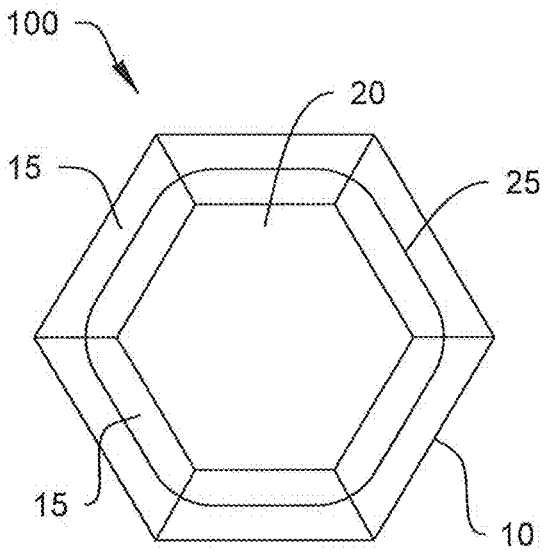
FIG. 5 is a back view of an embodiment of the invention during use.
Figure 6:
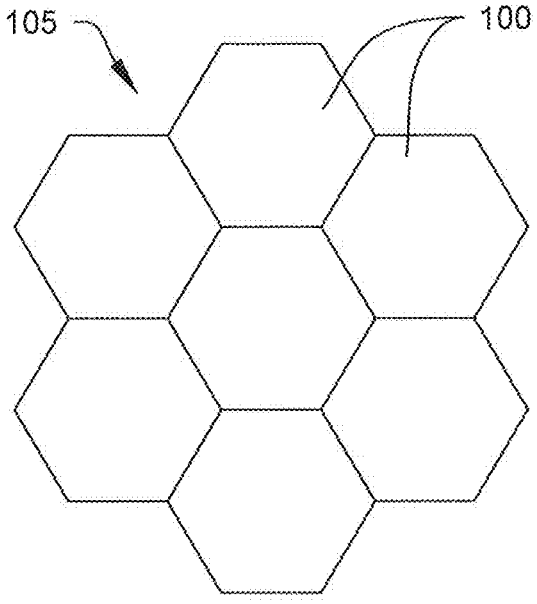
FIG. 6 is a front view of a sewn EPP block comprised of multiple patches created using an embodiment of the invention.

As shown in FIG. 5, the hexagonal-shaped foundation piece 20 that is partially encased within the hexagonal-shaped fabric piece 10 is used to create the hexagonal-shaped EPP patch 100 that is sewn with stitches 25 that are sewn through the seam allowances 15 of the fabric piece 10 and through the foundation piece 20 in order to hold the fabric piece 10 in the same size and geometric pattern as the underlying foundation piece 20, thereby yielding the hexagonal-shaped EPP patch 100. As shown by FIG. 6, multiple hexagonal-shaped EPP patches 100 may be combined and sewn together to form a block 105. In the prior art, the foundation piece 20 would have been made of paper, plastic or some other rigid or semi-rigid material, and it would have been manually removed either after the individual EPP patch 100 is constructed (as shown in FIG. 5), or after the block 105 is completed (as shown in FIG. 6). With the present invention, the foundation piece 20 is a pre-cut piece of nonwoven batting material that is not removed and remains part of the EPP patches, both in the completed blocks 105 and in the final completed quilt or quilted item.

Figure 3:
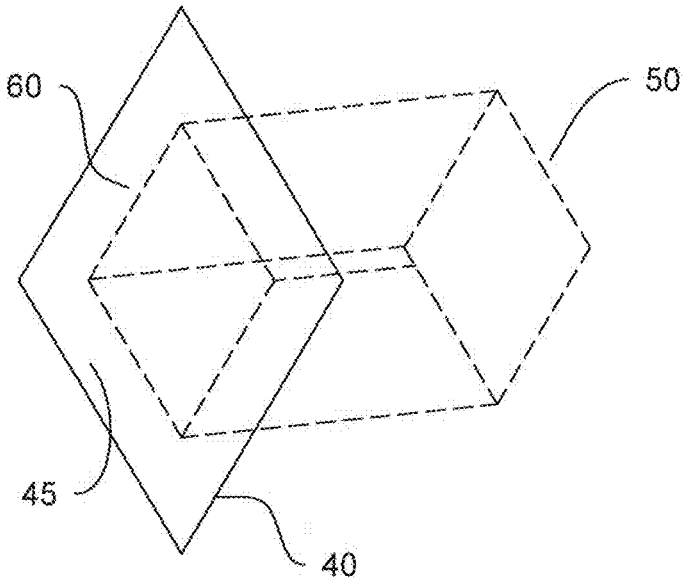
FIG. 3 is a back perspective view of an embodiment of the invention during use.
Figure 4:
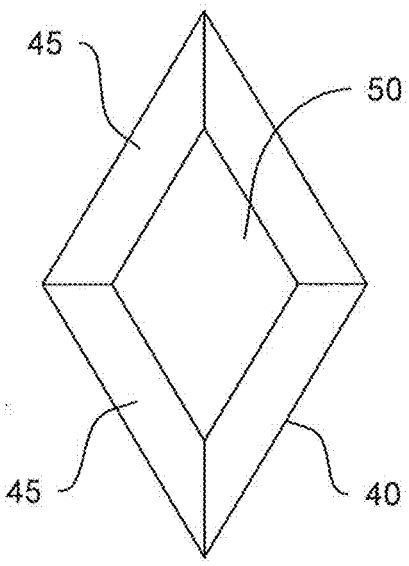
FIG. 4 is a back view of an embodiment of the invention during use.
Figure 7:
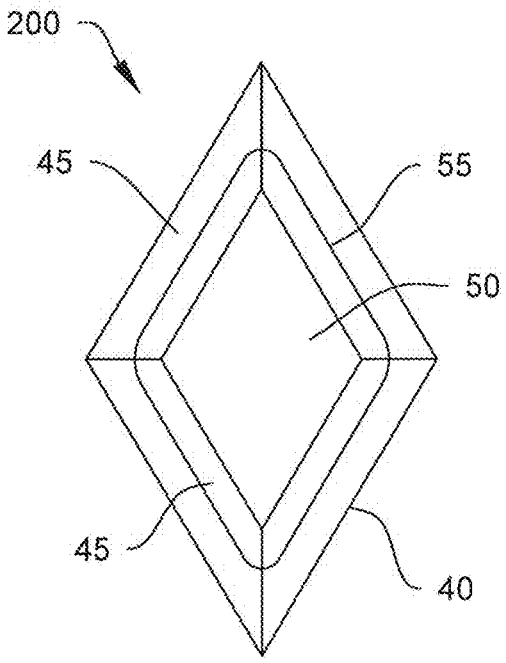
FIG. 7 is a back view of an embodiment of the invention during use.
Figure 8:
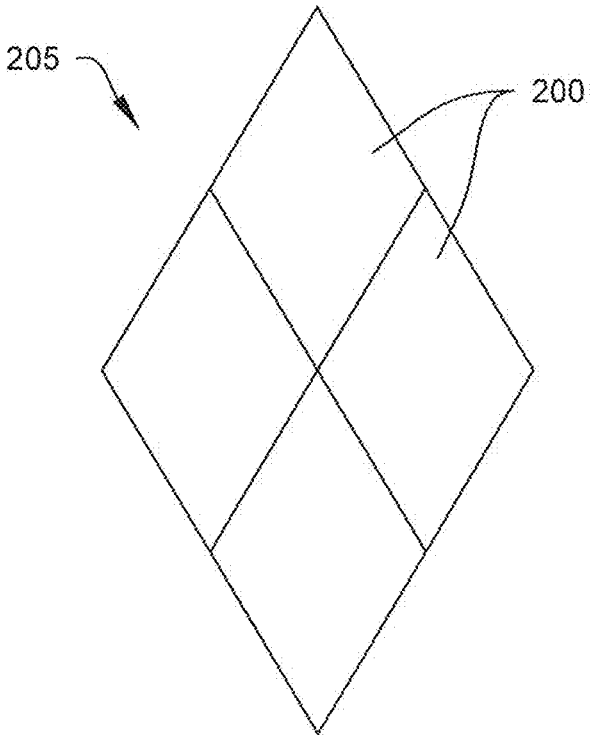
FIG. 8 is a front view of a sewn EPP block comprised of multiple patches created using an embodiment of the invention.
Figure 9:
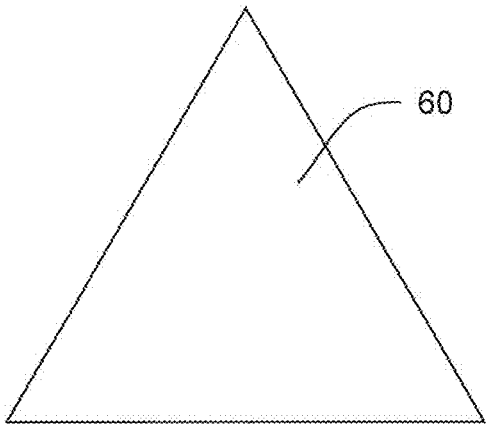
FIG. 9 is a front view of one of the pre-cut, nonwoven batting foundation pieces of the present invention.
Figure 10:
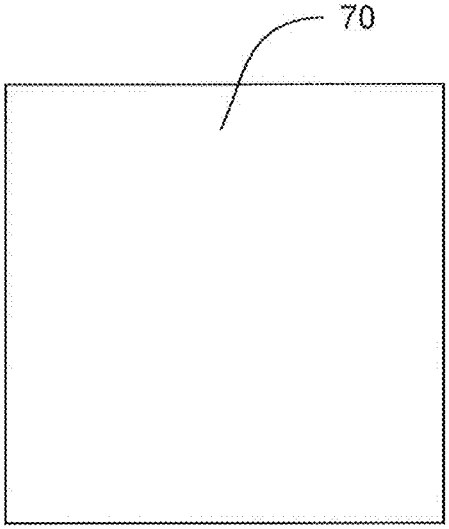
FIG. 10 is a front view of one of the pre-cut, nonwoven batting foundation pieces of the present invention.
Figure 11:
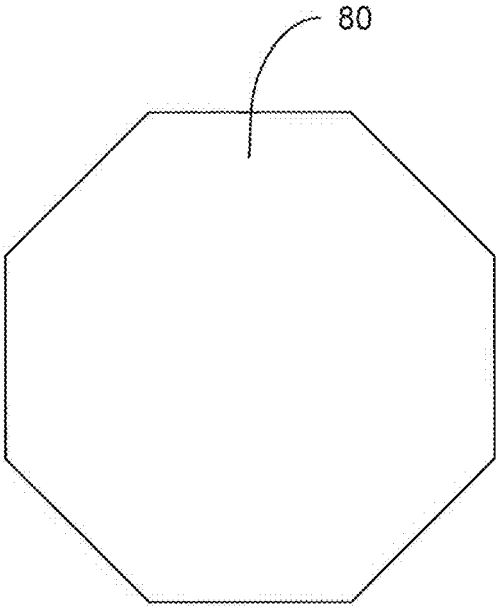
FIG. 11 is a front view of one of the pre-cut, nonwoven batting foundation pieces of the present invention.

FIGS. 3, 4, 7, 8 are variations on the same themes as discussed above with regard to FIGS. 1, 2, 5, 6. FIG. 3 shows a diamond-shaped foundation piece 50 being placed onto the wrong side of a diamond-shaped fabric piece 40. As illustrated by the diamond-shaped dotted lines 60 on the diamond-shaped fabric piece 40, the diamond-shaped fabric piece 40 is larger than the foundation piece 50 such that the four edges of the fabric piece 40 define areas of fabric that extend beyond the four edges of the foundation piece 50, and said areas comprise a diamond-shaped seam allowance 45. As shown in FIG. 4, the diamond-shaped seam allowance 45 is folded over the four edges of the foundation piece 50 such that the foundation piece 50 is partially encased in the fabric piece 40. As shown in FIG. 7, thread stitches 55 are sewn through the areas of seam allowance 45 so that a diamond-shaped EPP patch 200 is created. As shown in FIG. 8, multiple diamond-shaped EPP patches 200 formed using the foundation pieces of the present invention may be sewn together to form a diamond-shaped block 205. As discussed previously, with the present invention the diamond-shaped foundation pieces 50 will not be removed from the EPP patches 200 or the blocks 205 because they are made of a nonwoven batting material that is intended to remain part of the diamond-shaped EPP patches 200 through completion of the final quilt or quilted item. This is different from the prior art in which foundation pieces of paper, plastic, or other rigid or semi-rigid material would have been removed after patches were formed or after blocks were created.

It should be understood that the drawings of the block patterns 105, 205 are merely illustrative of a few types of blocks that may be created in the paper piecing process by the quilter. The reality is that an incredibly wide variety of block patterns may be created using the variously shaped and sized EPP patches corresponding to the variously shaped and sized nonwoven batting pieces of the present invention.

Figure 12:
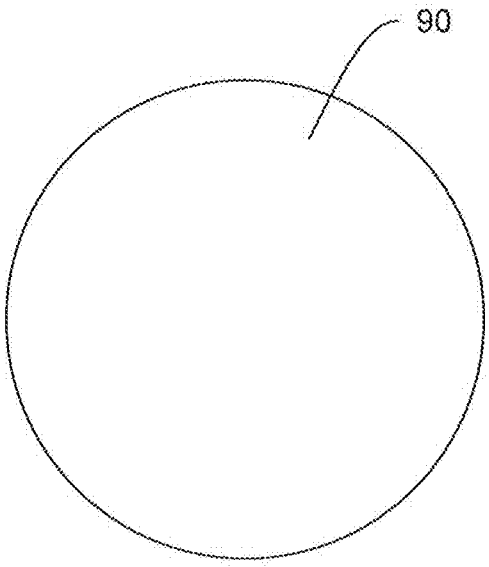
FIG. 12 is a front view of one of the pre-cut, nonwoven batting foundation pieces of the present invention.

FIGS. 9-12 are simply intended to represent the fact that the pre-cut nonwoven batting foundation pieces of the present invention may come in a wide variety of geometric shapes and sizes. The pre-cut foundation pieces can come in polygonal shapes, such as triangles 60, squares 70, and octagons 80. Obviously, various other polygonal shapes like pentagons, rhomboids, stars, etc. would also be possible. FIG. 12 illustrates that the pre-cut nonwoven batting foundation pieces could even have a circular shape 90.

It should be appreciated that kits containing multiple pre-cut foundation pieces of nonwoven batting material having the same size and same geometric shape could be provided for facilitating the EPP process and facilitating rapid creation of EPP patches and blocks. Likewise, kits containing multiple pre-cut foundation pieces of nonwoven batting having different shapes or different sizes could also be provided for facilitating the EPP process and making the rapid creation of EPP patches and blocks much easier. This would be of great benefit to both novice and experienced quilters alike.

As discussed previously, in a preferred embodiment of the invention, the nonwoven batting used for the pre-cut foundation pieces is a 100% polyester batting, such as, for example, the Thermore® batting product that is manufactured by Hobbs Bonded Fibers NA, LLC. Such 100% polyester batting is advantageous because it does not shrink when washed, it will not wrinkle, and it is thin enough and lightweight enough to provide a low-loft appearance that is desirable for EPP projects, yet it is durable and sturdy enough to be used for foundation pieces that are hand sewn to small, overlying fabric pieces. Polyester batting is inherently stiff enough to hold the pattern for the fabric pieces in order to make the EPP patches, and in that regard it performs at least as well as paper, freezer paper, or cardboard for the purpose of serving as a foundation for the EPP patches.

In another embodiment of the invention, a nonwoven batting material made out of cotton or a polyester-cotton blend may be used for pre-cutting a variety of foundation pieces having predetermined sizes and shapes.

In yet a further embodiment, such polyester, cotton, or polyester-cotton blended nonwoven battings may be coated or impregnated with a stiffening resin that causes the pre-cut foundation pieces to be even stiffer so that they are better able to hold the pattern of the EPP patches during the EPP process. This is not necessary with 100% polyester nonwoven batting for the reasons discussed above, but adding a stiffening resin to cotton or poly-cotton blended nonwoven batting can greatly enhance the stiffness of the foundation pieces and the patches. A water soluble stiffening resin is preferable so that it can be washed out when the final completed quilt or quilted item is later washed.

In an additional embodiment, the pre-cut foundation pieces having various geometric patterns and sizes may also be coated with an adhesive on at least one side such that they will have at least one "tacky" side. In this way, the "wrong side" (back side) of a fabric piece can be temporarily adhered to that tacky side of the pre-cut nonwoven batting foundation piece using the adhesive prior to the interconnecting seams being sewn through the fabric piece and the foundation piece during sewing to create the EPP patch. This adhesive coating that is on at least one side of the precut foundation pieces may be covered with a release film prior to the time that the foundation pieces are to be used in connection with the fabric pieces to create the EPP patches. Use of such release films on the tacky side of the foundation pieces will make the process of using adhesive-coated foundation pieces in the EPP method less messy and less difficult. The adhesive is preferably water soluble so that it can be washed out after the final quilt or quilted item is completed.

In some embodiments there may be an adhesive layer on both sides of the pre-cut nonwoven batting foundation pieces, and both adhesive layers may be covered with release films. Whether adhesive is applied to one or both sides of the foundation pieces, the adhesives that are used preferably will not be heat-activated adhesives since those types of adhesives would be inappropriate for most EPP projects that involve small patches being sewn by hand.

The embodiments and other features, aspects, and advantages of the present invention may be best understood and appreciated with reference to the drawings, descriptions, and claims. Where used in the various figures of the drawings, the same numerals designate the same or similar parts. Furthermore, when the terms "top", "bottom", "front", "back", "distal", "proximal", "lateral", "vertical", "horizontal", "central", "first", "second", "third", "inside", "internal", "outside", "external", "end", "ends", "side", "sides", "edge", "edges" and similar terms are used herein, it should be understood that, unless otherwise specifically stated or otherwise made specifically clear by context, these terms have reference only to the structure shown in the drawings as it would appear to a person viewing the drawings, and such terms are utilized in order to facilitate describing the invention and in order to facilitate a better understanding of the invention.

Although the invention has been described with reference to several specific embodiments, this description is not meant to be construed in a limiting sense. Various modifications of the disclosed embodiments, as well as alternative embodiments of the invention, will be apparent to persons skilled in the art upon reference to the description of the invention. It is, therefore, contemplated that the appended claims will cover such modifications that fall within the scope of the invention.

I claim:

1. A method for facilitating English Paper Piecing and paper piecing quilting projects comprised of:

obtaining a nonwoven batting material;

selecting a desired shape and size for die cutting the batting material into at least one individual batting piece;

die cutting the batting material into the selected shape and size to form the individual batting piece;

repeating the die cutting process so that multiple individual batting pieces are formed;

providing the multiple individual batting pieces to a quilter in the form of a kit for use by the quilter as foundation pieces in paper piecing projects.

2. The method of claim 1, wherein the nonwoven batting material is 100% polyester batting.

3. The method of claim 1, wherein the nonwoven batting material has an adhesive coating on at least one side, and wherein the adhesive coating is water soluble.

4. The method of claim 1, wherein the nonwoven batting material is 100% cotton batting.

5. The method of claim 1, wherein the individual batting pieces are polygonal in shape such that the all of the individual batting pieces provided to the quilter in the kit for use as foundation pieces have a uniform polygonal shape.

6. The method of claim 4, wherein the nonwoven cotton batting is impregnated with a stiffening resin and is coated on at least one side with a layer of adhesive that is water soluble.

7. The method of claim 1, wherein the nonwoven batting material is a mixture of cotton and polyester.

8. The method of claim 1, wherein the multiple individual batting pieces provided to the quilter in the kit for use as foundation pieces are not removed from the paper piecing project prior to its completion and therefore remain a part of the completed project.

9. An improvement to the English Paper Piecing method of creating paper piecing projects comprising the following method:

obtaining a first piece of batting material;

selecting a desired shape and size for die-cutting multiple foundation pieces out of the first piece of batting material;

die-cutting multiple foundation pieces of a uniform shape and size out of the first piece of batting material and thereby creating multiple, separate foundation pieces with a uniform shape and size that may later be used in paper piecing projects;

concurrently providing the multiple foundation pieces to a quilter for use in creating a paper piecing project.

10. The method of claim 9, further including:

prior to die-cutting, impregnating the first piece of batting material with a water soluble stiffening resin and coating one side of the first piece of batting material with a water soluble adhesive such that each of the foundation pieces ultimately provided to the quilter is comprised of batting material, water soluble stiffening resin, and adhesive coating.

11. The method of claim 10, wherein the first piece of batting material is nonwoven polyester batting.

12. The method of claim 10, wherein the first piece of batting material is nonwoven cotton batting.

13. The method of claim 10, wherein the first piece of batting material is a nonwoven batting comprised of a mixture of cotton and polyester fibers.

14. The method of claim 9 further comprising:

the step of concurrently providing multiple foundation pieces to a quilter is done in the form of a kit that contains the multiple foundation pieces for the quilter's use in a paper piecing project.

15. The method of claim 10 further comprising:

applying a sheet of release film to the adhesive coating prior to die-cutting the multiple foundation pieces out of the first piece of batting material such that following the die-cutting of the multiple foundation pieces from the first piece of batting material, each of the foundation pieces will be comprised of batting material, water soluble stiffening resin, adhesive coating, and release film that is releasably attached to the adhesive coating.

16. The method of claim 9 further comprising:

the quilter cutting a piece of fabric into a fabric patch that has the same shape as a selected foundation piece, but with the size of the fabric patch being larger than the foundation piece;

the quilter attaching the fabric patch directly to the foundation piece by sewing them together and thereby creating a paper piecing patch for further use in creating the paper piecing project;

the quilter repeating the first two steps as many times as desired until a desired number of paper piecing patches have been created;

the quilter attaching multiple paper piecing patches together by sewing them together to form a block;

the quilter creating one or more blocks in the above manner, wherein the one or more blocks will be incorporated into the final paper piecing project;

the quilter completing the paper piecing project without ever removing the multiple foundation pieces.

17. An improvement to the English Paper Piecing method of quilting comprising the following method:

obtaining a first piece of batting material;

selecting desired shapes and sizes for die-cutting multiple foundation pieces out of the first piece of batting material, wherein the shapes and sizes need not be uniform;

die-cutting the first piece of batting into multiple foundation pieces having the selected shapes and sizes that may later be used in paper piecing projects;

concurrently providing the multiple foundation pieces to a quilter for use in creating a paper piecing project;

the quilter cutting pieces of fabric into fabric patches that have shapes corresponding to the provided foundation pieces, but with the size of the fabric patches being larger than the provided foundation pieces;

the quilter attaching the fabric patches directly to the respective foundation pieces by sewing the fabric patches to the foundation pieces and thereby creating multiple paper piecing patches for use in creating a quilt;

the quilter attaching multiple paper piecing patches together by sewing them together to form a block;

the quilter creating one or more blocks in the above manner, wherein the one or more blocks will be incorporated into a quilt top;

the quilter completing a quilt by attaching the quilt top comprised of the one or more blocks to a second piece of batting material and a quilt bottom by sewing the quilt top, the second piece of batting, and the quilt bottom together to form a completed quilt.

18. The method of claim 17 further comprising:

the quilter refraining from ever removing the multiple foundation pieces from the quilt top such that the multiple foundation pieces remain a part of the completed quilt.

* * * * *